United States Patent [19]

Steinbrink

[11] 4,416,128

[45] Nov. 22, 1983

[54] CYLINDER LOCK

[75] Inventor: Wilfried Steinbrink, Heiligenhaus, Fed. Rep. of Germany

[73] Assignee: C. Ed. Schulte GmbH, Velbert, Fed. Rep. of Germany

[21] Appl. No.: 271,845

[22] Filed: Jun. 9, 1981

[51] Int. Cl.[3] ..... E05B 19/02; E05B 27/02

[52] U.S. Cl. ..... 70/364 A; 70/407; 70/409

[58] Field of Search ..... 70/364 A, 407, 405, 70/406, 408, 409, 402

[56] References Cited

U.S. PATENT DOCUMENTS 1,280,633 10/1918 Baird ..... 70/407

3,287,945 11/1966 Yulkowski ..... 70/406

FOREIGN PATENT DOCUMENTS 2736331 11/1978 Fed. Rep. of Germany ..... 70/406

*Primary Examiner*—Robert L. Wolfe

*Attorney, Agent, or Firm*—Michael J. Striker

[57] ABSTRACT

A cylinder lock has a housing with a rotatably insertable cylinder having a key passage for an insertable flat key whose front part has locking notches associated with cylinder pins arranged in openings of the cylinder for retaining the cylinder pins. The flat key is provided at both its lateral sides with longitudinal grooves for receiving longitudinal ribs provided on the lateral sides of the key passage for the lateral profile variation. The longitudinal grooves on both lateral faces of the flat key lie with their bottom faces on lines which extend parallel to and at a distance from one another. The parallel lines extending at a distance from one another are arcuate at least in one partial region, and the convexly protruding central part of one arcuate line extend at least close to a straight line connecting the end points of the second arcuate line.

7 Claims, 5 Drawing Figures

CYLINDER LOCK

BACKGROUND OF THE INVENTION

The invention relates to a cylinder lock composed of a housing and a cylinder rotatably supported therein and having a key passage for the insertable flat key which has a front part with locking notches associated with cylindrical pins arranged in openings of the cylinder for retaining the pins, and the flat key has at its both lateral faces longitudinal grooves for receiving longitudinal ribs provided on the lateral faces of the key passage for lateral profile variation, wherein the longitudinal grooves at both lateral faces of the flat key lie in parallel lines extending at a distance from one another. In such a construction of the flat key the corresponding longitudinal ribs on both lateral faces of the above mentioned key passage also lie with their free ends on parallel lines extending at a distance from one another and formed by straight lines. A free space is thereby formed in the key passage between the longitudinal ribs, in which a picking pistol can be inserted, whereby the cylinder lock can be opened without the proper key.

A cylinder lock was also proposed in which the longitudinal ribs on both lateral faces of the key passage protrude so far that they extend close to the longitudinal centerline of the key passage or cross the longitudinal centerline. Thereby a free space in the key passage is avoided so that a picking pistol cannot be inserted. The longitudinal grooves provided in the flat key for receiving the longitudinal ribs of the key passage engage however so deep into the flat key that its cross section is considerably weakened or the variation is limited.

SUMMARY OF THE INVENTION

The invention has the object to provide a cylinder lock of the above mentioned type, in which these disadvantages are eliminated, wherein the flat key has a sufficiently great cross section and thereby a sufficient strength and an actuation of the cylinder lock with a picking pistol is prevented.

This object is solved in accordance with the present invention in that the both parallel lines extending at a distance from one another, against which the longitudinal grooves of the flat key lie with their bottom faces, extend at least in a partial region arcuately and the convexly protruding central part of one arcuate line extends at least close to a straight line which connects the end points of the second arcuate line. Thereby it is attained in a simple manner that the longitudinal grooves of the flat key do not extend too deep into the key cross section, inasmuch as the lines which extend parallel to one another and against which the longitudinal grooves of the flat key lie with their bottom faces, are arranged at a distance from one another. Thereby the key obtains a sufficient strength. The proper key passage has because of this a free space which however is curved as a result of the arcuate running of the lines, so that the actuation of the cylinder lock with a picking pistol is impossible inasmuch as for this actuation a rectilinearly extending free space is necessary.

The lines against which the longitudinal grooves of the flat key lie with their bottom faces can at least in a partial region run in circularly arcuate manner. Because of this it is attained in a simple manner that the longitudinal grooves of the flat key extend with their bottom faces along a line having the sharp of a circular arc.

The partial region in which the lines run in an arcuate manner can embrace the variation region of the locking notches of the flat key. Thereby the arcuate running of the lines is provided in a simple manner exactly in the region which embraces the variation region of the locking notches of the flat key, so that directly in this region the picking pistol cannot operate to actuate the cylindrical pins.

The partial region in which the lines run in an arcuate manner can be arranged with its arc height substantially symmetrical to the longitudinal centerline of the cylinder pins. Because of the arcuate shape of the lines against which the longitudinal grooves of the flat key with their bottom faces lie, engages the part of the key section the ends of the cylinder pins facing towards the front part of the key, substantially in the region of their longitudinal centerline, so that the arrangement of the cylinder pins are not affected.

The partial region in which the lines extend in an arcuate manner, can extend from the end forming the front part to the part of the key section forming the key back with its guide. With the exception of the part forming the key back with its guide, the lines against which the longitudinal grooves of the flat key lie with their bottom faces are thereby formed arcuate.

The bottom faces of the longitudinal grooves of the flat key which lie against the lines can extend in correspondence with the arcuate lines also in an arcuate manner. Thereby the bottom faces of the longitudinal grooves of the flat key are formed in a simple manner arcuate.

The lateral faces of the flat key can extend parallel to both lines which are spaced from one another and are curved in an arcuate manner. Thereby the entire cross section of the flat key can be curved arcuately in a simple manner. The longitudinal grooves can in this case be provided in the key section with an identical depth.

The lateral faces of the flat key can also extend rectilinearly. Thereby the key is formed flat in a simple manner even though the lines against which the longitudinal grooves of the flat key lie with their bottom faces extend in an arcuate manner.

The part of the key section forming the key back with its guide can be bent and laterally offset to extend parallel to the longitudinal centerline of the cylinder pin.

Thereby the thickness of the curved flat key is reduced in a simple manner. Moreover, the end of the key passage section which opens at the outer surface of the cylinder extends substantially perpendicular to the outer surface.

The key passage provided in the cylinder may have a cross section corresponding to the cross section of the flat key. Thereby the key passage has a cross section which allows the insertion of the flat key.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

The invention is shown in two embodiments in the drawings, wherein.

DESCRIPTION OF THE PREFERRED EMBODIMENTS

Figure 1:
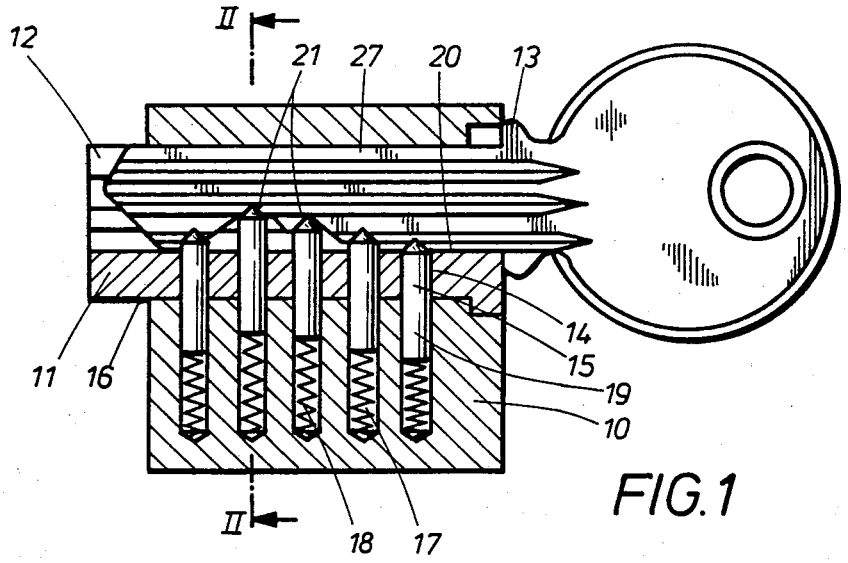
FIG. 1 is the inventive cylinder lock in a longitudinal section.

The cylinder lock shown in the drawing is composed of a housing 10 and a cylinder 11 rotatably supported therein and having a key passage 12. The cylinder 11 is actuated by a key 13 insertable into the key passage 12, inasmuch as the front part 20 is arranged to cooperate with cylinder pins 15 inserted into openings 14 of the cylinder 11, whereby the cylinder pins coincide with the outer face 16 of the cylinder 11. This position is shown in FIG. 1. Housing pins 19 inserted into openings 17 of the housing 10 and arranged under the action of helical pressure springs 18 extend in the event of the removed key 13 with their front ends into the openings 14 of the cylinder 11 so that the cylinder 11 is locked against rotation.

For actuating the cylinder lock, the key 13 must have a shape corresponding to the shape of the key passage 12 to allow the insertion of the key 13 into the key passage 12. Moreover, a front part 20 of the key 13 must have locking notches 21 corresponding to the length of the cylinder pins 15, so that the cylinder pins 14 coincide with the outer face 16 of the cylinder 11 and thereby a rotation of the cylinder 11 is possible.

Figure 3:
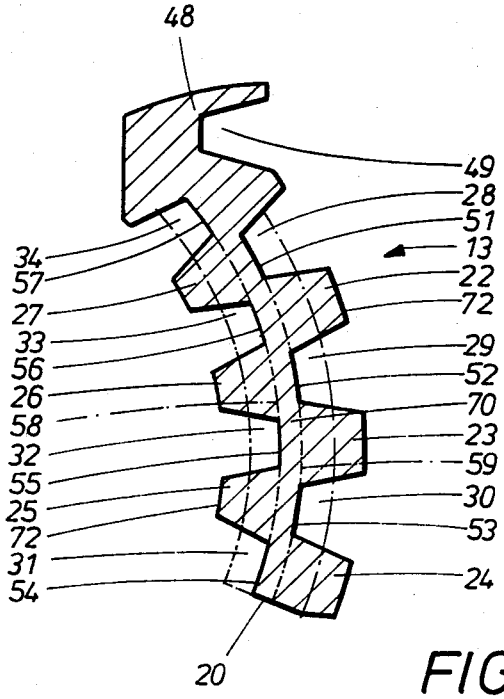
FIG. 3 is a section corresponding to the section of FIG. 2 through the flat key, which is inserted in the key passage of the cylinder.

FIG. 3 shows a cross section of a part of the key 13, insertable into the key passage 12 of the cylinder 11. The key cross section is so cut through that it has a lateral profile variation formed by longitudinal ribs 22–27. Thereby, a simultaneous lateral profile variation because of longitudinal grooves 28–34 forming gaps between the ribs is provided. The general main key has all longitudinal grooves 28–34, but does not have longitudinal ribs 22–27.

Figure 2:
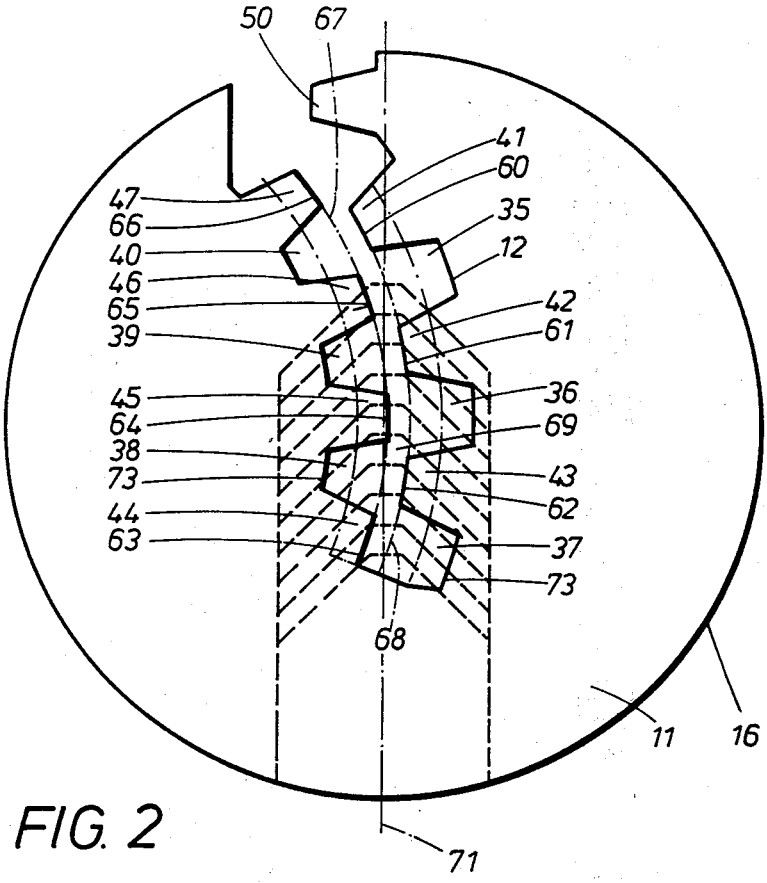
FIG. 2 is a section along the line 2—2 in FIG. 1, through the rotary cylinder, on a greater scale.

As can be seen from FIG. 2, the key passage 12 in the cylinder 11 is designed correspondingly. The key passage 12 of the cylinder 11 has longitudinal grooves 35–40 corresponding to the longitudinal ribs 22–27 which serve for the lateral profile variation. The key passage 12 also has longitudinal ribs 41–47 which correspond to the longitudinal grooves 28–34 of the key 13 also serving for the lateral profile variation.

As can be seen from FIG. 3, the longitudinal ribs 22–27 and the longitudinal grooves 28–34 extend approximately over the entire longitudinal faces of the key 13 and up to the back 48 which with its guide groove 49 does not serve for the longitudinal profile variation. The key passage 12 is provided with a corresponding guide rib 50. The key back 48 extends to the outer face 16 of the cylinder 11 and coincides with the latter. This means that the key passage 12 of the cylinder 11 also extends to the outer face 16 of the cylinder 11.

The longitudinal grooves 28–34 on both lateral faces of the flat key lie with their bottom faces 51–57 on parallel lines 58 and 59 extending at a distance from one another. These lines 58 and 59 are shown in FIG. 3 in dash dot lines. Both parallel lines 58, 59 extending at a distance from one another, against which the longitudinal grooves 28–34 of the flat key 13 lie with their bottom faces 51–57, extend in an arcuate manner, and particularly as circular arcs. The convexly protruding central part of one arcuate line 58 extends at least close to a not shown straight line which connects the end points of the second arcuate line 59. In the shown embodiment the convexly protruding central part of the arcuate line 58 crosses the not shown straight line by a considerable piece. The key passage 12 in the cylinder 11 is formed correspondingly. The longitudinal ribs 41–47 engaging into the longitudinal grooves 28–34 of the key 13 lie with their free end faces 60–66 on two lines 67, 68 which extend parallel to one another in an arcuate manner, as shown in dash dot lines in FIG. 2. Both lines 67, 68 are arranged at a distance from one another so that the key passage 12 between the longitudinal ribs 41–47 has a free space 69 which however extends in an arcuate manner so that an actuation of the cylinder pin 15 with a picking pistol is not possible. On the other hand, the key 13 obtains a relatively great cross section face because the distance between the lines 58, 59 so that the key can withstand all loads.

A strip 70 of the key 13 extending between both arcuate lines 58, 59 is with its arc height in the variation region of the locking notches 21 arranged substantially symmetrical to the longitudinal centerline 71 of the cylinder pin 15. Thereby the strip 70 is always in operative connection with the flattened tips of the cylinder pins 15, regardless of the variation region of the locking notches 21, so that despite the arcuate construction of the strip 70 the actuation of the cylinder pins 15 is not affected. The variation region of the locking notches 21 is shown in FIG. 2 in dotted lines.

The bottom faces 51–57 of the longitudinal grooves 28–34 of the flat key 13, which lie against the lines 58, 59, extend in correspondence with the arcuate lines 58, 59 also in an arcuate manner. The end faces 60–66 of the longitudinal ribs 41–47 of the key passage 12 also extend correspondingly in an arcuate manner.

The lateral faces 72 of the flat key 13 formed by the longitudinal ribs 22–27 also extend parallel to the lines 58, 59 which are spaced from one another and curved in an arcuate manner. Correspondingly, the lateral faces 73 of the key passage 12 formed by the longitudinal grooves 35–40 are also curved in an arcuate manner and extend parallel to the arcuate lines 67, 68.

The part of the key section forming the key back 48 with its guides 49, 50 is bent and extends in a laterally offset manner parallel to the longitudinal centerline 71 of the cylinder pins 51. Thereby the thickness of the key 13, despite the arcuate construction, is held as small as possible.

Figure 4:
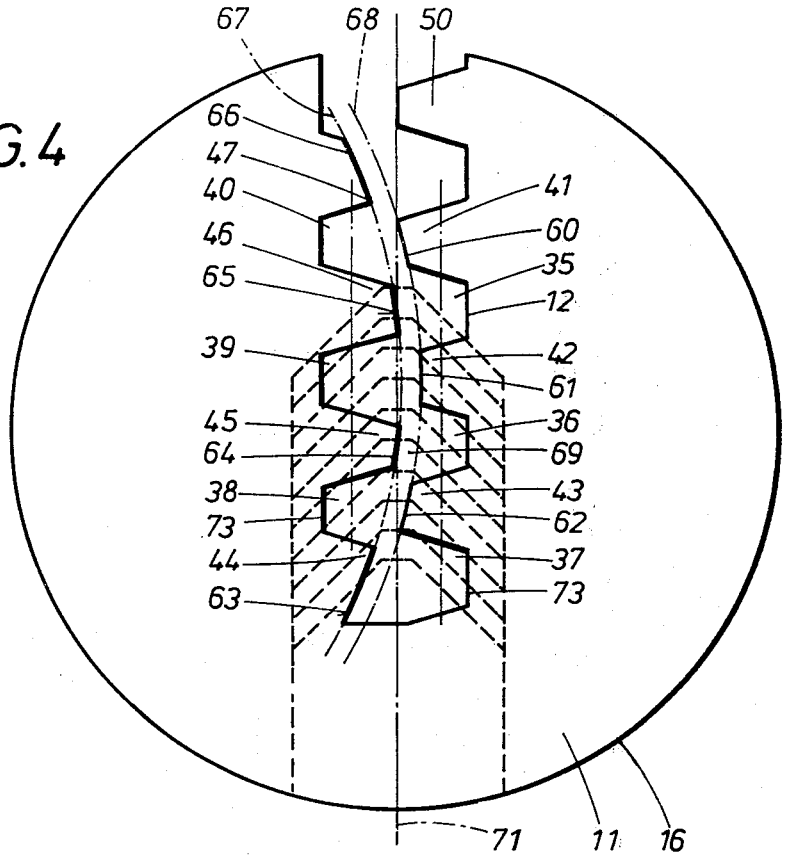
FIG. 4 is a second embodiment in a section corresponding to the section of FIG. 2.
Figure 5:
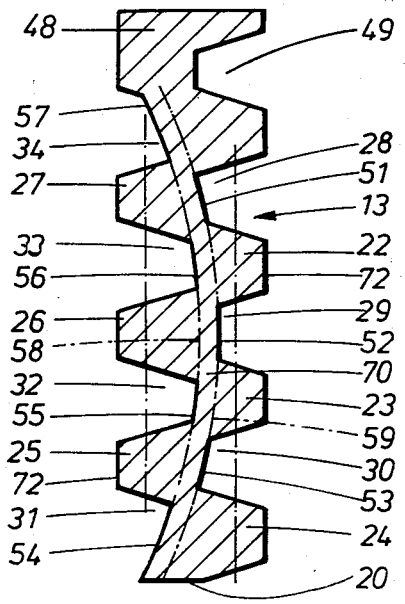
FIG. 5 is a section of the key, corresponding to the section of FIG. 4.

In the second embodiment shown in FIGS. 4 and 5, the section of the part of the key 13 which is insertable into the key passage 12 of the cylinder 11 is shown in FIG. 5. The key cross section is cut through so that it has a lateral profile variation by the longitudinal ribs 22–27. A simultaneous lateral profile variation is provided by the longitudinal grooves 28–34 forming the gaps between the ribs. The general main key has all longitudinal grooves 28–34, but does not have the longitudinal ribs 22–27.

As can be seen from FIG. 4, the key passage 12 in the cylinder 11 is designed correspondingly. The key passage 12 of the cylinder 11 has the longitudinal grooves 35–40 corresponding to the longitudinal ribs 22–27 which serve for lateral profile variation. The key passage 12 also has the longitudinal ribs 41–47 which correspond to the longitudinal grooves 28–34 of the key 13, also serving for the lateral profile variation.

As can be seen from FIG. 5, the longitudinal ribs 22–27 and the longitudinal grooves 28–34 extend approximately over the entire lateral faces of the key 13 and to the back 48 with its guiding groove 49 which does not serve for the lateral profile variation. The key passage 12 is provided with a corresponding guide rib 50. The key back 48 extends to the outer surface 16 of the cylinder 11 and coincides with the same. This means that the key passage 12 of the cylinder 11 also extends to the outer surface 16 of the cylinder 11.

The longitudinal grooves 28–34 on both lateral faces of the flat key lie with their bottom faces 51–57 on parallel lines 58, 59 arranged at a distance from one another. These lines 58 and 59 are shown in FIG. 5 in dash dot lines. The parallel lines 58, 59 extending at a distance from one another, against which the longitudinal grooves 28–34 of the flat key 13 lie with their bottom faces 51–57, extend in an arcuate manner, and particularly as circular arcs. The convexly protruding central part of one arcuate line 58 extends at least close to a not shown straight line which connects the end points of the second arcuate line 59.

In the shown embodiment, the convexly protruding central part of the arcuate line 58 crosses the not shown straight line by a considerable piece.

The key passage 12 in the cylinder 11 is formed correspondingly. The longitudinal ribs 41–47 engaging in the longitudinal grooves 28–34 of the key 13 lie with their free end faces 66–66 on lines 67, 68 which are parallel to one another and arcuate, as shown in FIG. 4 in dash dot lines. Both lines 67, 68 are arranged at a distance from one another, so that a free space 69 is produced in the key passage 12 between the longitudinal ribs 41–47, the free space 60 also extending in an arcuate manner so that the cylinder pins 15 cannot be acutated by a picking pistol. On the other hand, the key 13 has a great cross section face because of the distance the lines 58, 59, so that the key can withstand all loads.

The strip 70 of the key 13 produced between both arcuately extending lines 58, 59 is with its arc height in the variation region of the locking notches 21 arranged substantially symmetrical to the longitudinal centerline 71 of the cylinder pins 15. Thereby the strip 70 is always in operative connection with the flattened tips of the cylinder pins 15, regardless of the variation region of the locking notches 21, so that despite the arcuate construction of the strip 70 the actuation of the cylinder pin 15 is not affected. The variation region of the locking notches is shown in FIG. 4 in dotted lines.

The bottom faces 51–57 of the longitudinal grooves 28–34 of the flat key 13 which lie against the lines 58, 59, extend also arcuately in correspondence with the arcuate lines 58, 59. Correspondingly, the end faces 60–66 of the longitudinal ribs 41–47 of the key passage 12 also extend arcuately in a similar manner.

The lateral faces 72 of the key 13, formed by the longitudinal ribs 22–27, extend in this embodiment rectilinearly and parallel to the movement path of the cylinder pins 15. The lateral faces 73 of the locking passage 12 formed by the longitudinal grooves 35–40 also extend rectilinearly. Thereby the thickness of the flat key 13 is reduced in a simple manner.

As mentioned above, only exemplary implementations of the invention are illustrated by the above presented embodiments, and the invention is not limited thereby. Moreover, other embodiments and variations are possible. Thus, it is possible to curve the lateral faces 72 of the flat key 13 also in an arcuate manner, whereas the radius thereof deviates from the radius of the arcuate lines 58, 59. The lateral profile variation of the flat key 13 can, instead of the longitudinal ribs 22–27 and longitudinal grooves 28–34, also have only longitudinal ribs or only longitudinal grooves.

It will be understood that each of the elements described above, or two or more together, may also find a useful application in other types of constructions differing from the types described above.

While the invention has been illustrated and described as embodied in a cylinder lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cylinder lock comprising a housing; a cylinder rotatably arranged in said housing and having a key passage with two lateral walls having respectively first and second pluralities of longitudinal ribs for lateral profile varying, the longitudinal ribs of said first and second pluralities of ribs having end faces lying respectively on two limiting lines which define therebetween a uniformly extending strip-like gap in said key passage, said cylinder also having a plurality of openings; a plurality of pins arranged in said openings of said cylinder and having axes which define a longitudinal center plane; and a substantially flat key insertable into said key passage of said cylinder and having a front part provided with a plurality of notches cooperating with said pins in said cylinder, said key having first and second lateral faces provided respectively with first and second pluralities of longitudinal grooves for receiving said longitudinal ribs of said key passage of said cylinder; the longitudinal grooves of said first and second pluralities of grooves having bottom faces lying respectively on two further limiting lines which define therebetween a uniformly extending strip in said flat key, said strip-like gap of said key passage and said strip of said flat key being arcuate at least in the height region of said notches of said flat key, and said longitudinal center plane defined by said axes of said pins cutting through the arc of said strip-shaped gap and said strip as a secant, so that the arc extends substantially identically far at both sides of said longitudinal center plane.

2. A cylinder key as defined in claim 1, wherein said arcuate strip-shaped gap of said cylinder and said strip of said key each is substantially symmetrical to said longitudinal center plane of said pins.

3. A cylinder lock as defined in claim 1, wherein said key has a cross section with a part forming a key rear and provided with guides, said arcuate strip-shaped gap of said cylinder and said strip of said key each extending to said part forming said key rear with said guides.

4. A cylinder lock as defined in claim 1, wherein said limiting lines of said key are arcuate, said bottom faces of said key lying on said limiting lines extending in an arcuate manner in correspondence with said arcuate lines.

5. A cylinder lock as defined in claim 1, wherein said limiting lines of said key are arcuate, said key having lateral faces extending parallel to said arcuate limiting lines.

6. A cylinder lock as defined in claim 1, wherein said key has a cross section with a part forming key rear provided with guide, said part forming said key rear with said guide being bent and extending laterally offset parallel to said longitudinal center plane of said pins.

7. A cylinder lock as defined in claim 1, wherein the arc of said strip-like gap of said key passage and of the strip of said flat key is circular.

* * * * *